US006682071B1

(12) United States Patent
Carsten

(10) Patent No.: US 6,682,071 B1
(45) Date of Patent: Jan. 27, 2004

(54) TOY BALL GAME WITH PLAY MECHANISM

(75) Inventor: Røn Carsten, Billund (DK)

(73) Assignee: Interlego AG, Baar (CH)

( * ) Notice: Subject to any disclaimer, the term of this patent is extended or adjusted under 35 U.S.C. 154(b) by 70 days.

(21) Appl. No.: 10/048,773

(22) PCT Filed: Jul. 5, 2000

(86) PCT No.: PCT/DK00/00367

§ 371 (c)(1),
(2), (4) Date: Jan. 4, 2002

(87) PCT Pub. No.: WO01/02069

PCT Pub. Date: Jan. 11, 2001

(30) Foreign Application Priority Data

Jul. 6, 1999 (DK) ..... 1999 00977

(51) Int. Cl.[7] ..... A63F 7/24

(52) U.S. Cl. ..... 273/119 R; 273/108.1; 273/108.53; 273/129 W

(58) Field of Search ..... 273/108, 108.53, 273/108.1, 108.55, 118 R, 119 R, 129 R, 129 V, 129 W

(56) References Cited

U.S. PATENT DOCUMENTS 2,884,253 A * 4/1959 Rivero-Ferro ..... 273/108.54
3,086,778 A 4/1963 Maurer
3,118,673 A 1/1964 Maurer
3,901,511 A * 8/1975 Garbark ..... 273/119 A
4,033,584 A * 7/1977 Smith ..... 273/108.55
4,065,129 A * 12/1977 Bartok ..... 273/121 A
5,697,613 A * 12/1997 Merino et al. ..... 273/129 W
5,785,313 A * 7/1998 Shiraishi ..... 273/108.1
5,810,362 A * 9/1998 Jensen ..... 273/317.3

FOREIGN PATENT DOCUMENTS

| | | |
|---|---|---|
| DE | 2263398 | 12/1972 |
| DE | 2604423 | 8/1976 |
| GB | 2064341 | 6/1981 |

* cited by examiner

*Primary Examiner*—Raleigh W. Chlu
(74) *Attorney, Agent, or Firm*—Pitney, Hardin, Kipp & Szuch LLP

(57) ABSTRACT

The invention relates to a toy ball game comprising a horizontally extending playface and having a play mechanism in the form of a toy figure arranged in such position on the playface that it protrudes thereabove and is arranged for being flexed away from a neutral position and by spring force revert to that neutral position whereby a face on the mechanism is able to transmit energy to a ball in order to cause the ball to move away from the mechanism and across the playface. The play mechanism is able to rotate about a vertical axis to enable the toy figure to face in the direction of his kick. From the mechanism an arm protrudes transversally and it is arranged to perform, in response to an influence exerted vertically by a finger, a flexing of the mechanism away from its neutral position. A face on the mechanism has a concave shape that matches the ball thereby allowing the ball to remain steadily positioned in contact with the concave face which means that the ball will always be positioned in front of the figure.

10 Claims, 2 Drawing Sheets

TOY BALL GAME WITH PLAY MECHANISM

This invention relates to a toy ball game with a field or a playface, wherein said playface comprises one or more mechanisms that protrude above the playface. The ball game can be a football game, and in that case the mechanisms simulate players on the field and are resiliently mounted on the playface and arranged for a user to manually flex them away from their neutral position. When a mechanism is subsequently let go, it will—due to the spring force—revert to its neutral position, the return movement of the mechanism will impart kinetic energy to a ball located on the playface close to the mechanism, ie at the foot of a simulated football player, whereby a kick is simulated that causes the ball to travel across the playface.

U.S. Pat. No. 3,086,778, U.S. Pat. No. 3,118,673, DE 1,163,712, and DE 2,263,398 disclose such toy ball games wherein the players on the field are figures with human features, and wherein there are provided at the foot of the figure disc-shaped, spherical or barrel-like base elements that have circular horizontal cross sections. When such figures are flexed away from their neutral position and let go, following which spring force causes them to revert to their neutral position, the base element will impart 'a kick' to the ball whereby the ball is caused to move away from the figure.

These prior art toy ball games are associated with several drawbacks. The play figures in all of these prior art toy ball games are mounted on the field in such a manner that they are unable to rotate about a vertical axis perpendicular to the field, while all players have a permanent orientation relative to the field whereby their faces are oriented eg in their own direction of attack. When a player is to kick the ball in a direction which is different from the direct attack direction, the figure has to kick the ball sideways or even backwards relative to his own orientation. This is unrealistic.

It is a further drawback of the prior art toy ball games that it is difficult to aim accurately with the player figures with ensuing poor kicking accuracy which results in frequent misses of the aim.

It is yet a further drawback of the prior art toy ball games that the user will naturally seize the head of the figure to flex the figure away from its vertical, neutral position. The figure being in the flexed position, the user has to aim by changing or adjusting the flexing direction while simultaneously having his hand or at least a finger on the figure's head where the hand prevents a clear view and thus also an accurate aim.

These an other drawbacks are remedied with a toy ball game according to the invention where the figures are able to rotate about an axis which is vertical or perpendicular to the field. Hereby a user is able to rotate the player figures in such a manner that the figure to be activated to kick the ball turns its front in the direction of aim which makes the game more authentic.

An arm that protrudes horizontally from the player figures enables the user to flex the figure away from its neutral position, which is usually vertical, by pressing that arm downwards. The hand of the user will hereby be located considerably lower than is the case when he seizes the figure at its head, and thus the hand will not prevent the user from obtaining a clear view in the aiming direction. Hereby the user obtains an improved overview of the game and a more accurate aim is hereby allowed.

In accordance with the invention the base elements of the player figures have a concave shape that matches the ball which permits the ball to occupy a stable position when in contact with the concave shape at the front of the base element. When the user changes his direction of aim by turning the player figure, the ball will follow and always be accurately and steadily positioned before the figure, and the user is allowed to kick the ball exactly in the desired direction.

The invention will now be explained with reference to a preferred embodiment and the drawings, wherein FIG. 1 is a sectional view of a field for use in connection with the invention;

Figure 1:
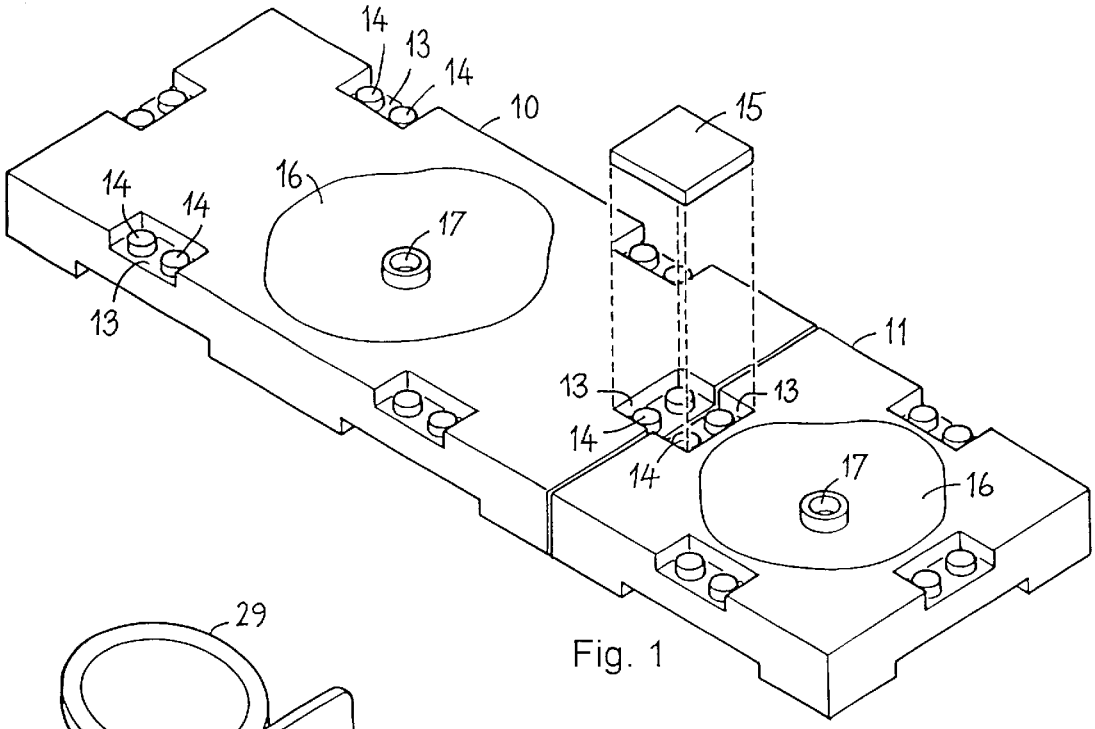

FIG. 1 is a sectional view of a field which, in this figure, consists of two rectangular field elements 10, 11 that are arranged adjacently each other. The field element 11 is square and the field element 10 is rectangular, its short side having the same length as the square element 11 and with a ratio of the long sides to the short sides of two to one. Laterally the field elements 10 and 11 have a number of rectangular cavities 13, and at the bottom of each cavity 13, two cylindrical coupling studs 14 are provided. The field elements 10 and 11 are arranged to border on each other at respective sides, and the cavities 13 in the two field elements jointly form a cavity with a square horizontal cross section. A known, square building element 15 having a (not shown) coupling cavity at the bottom can be arranged in the cavity that consists of the two rectangular cavities 13 on the two field elements where the coupling studs 14 are, in a manner known per se, received in the coupling cavity at the bottom of the building element 15 in a frictional engagement with the sides of the coupling cavity. Hereby the top face of the building element 15 will level with the top face of field elements 10 and 11. Each of the field elements 10 and 11 has a top face with a hollow or a cavity 16, and centrally in the hollow 16, at the lowermost point thereof, a tubular sleeve is arranged which will be explained later.

Figure 2:
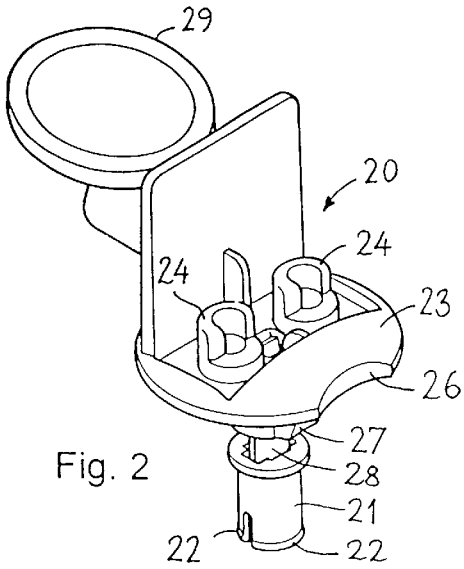
FIG. 2 is a perspective top view of a play mechanism for positioning on the field shown in FIG. 1.
Figure 3:
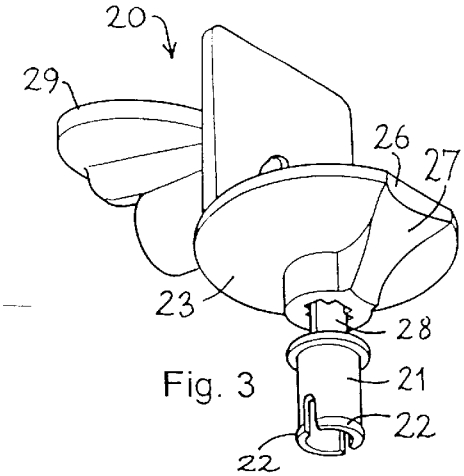
FIG. 3 is a perspective bottom view of the play mechanism shown in FIG. 2.

FIGS. 2 and 3 show a play mechanism 20 having at its bottom a cylindrical stud 21 which is, at its free end, provided with protruding snap beads 22 and slotted to make the end of the stud resilient and compressible. The play mechanism has a base element 23 in the form of a circular disc, the top face and bottom face of which are both arched or dome-shaped. On the top face of the base element 23 of the play mechanism, there are two generally cylindrical coupling studs 24 which are, in principle, of the same kind as the coupling studs 14. At its periphery the base element 23 has a cavity 26, and at the bottom face there is a corresponding cavity 27. The base element 23 of the play mechanism is secured to the stud 21 by means of a spring, such as a leaf spring 28. The play mechanism has an arm which is arranged diametrically opposite the cavities 26 and 27.

Figure 5:
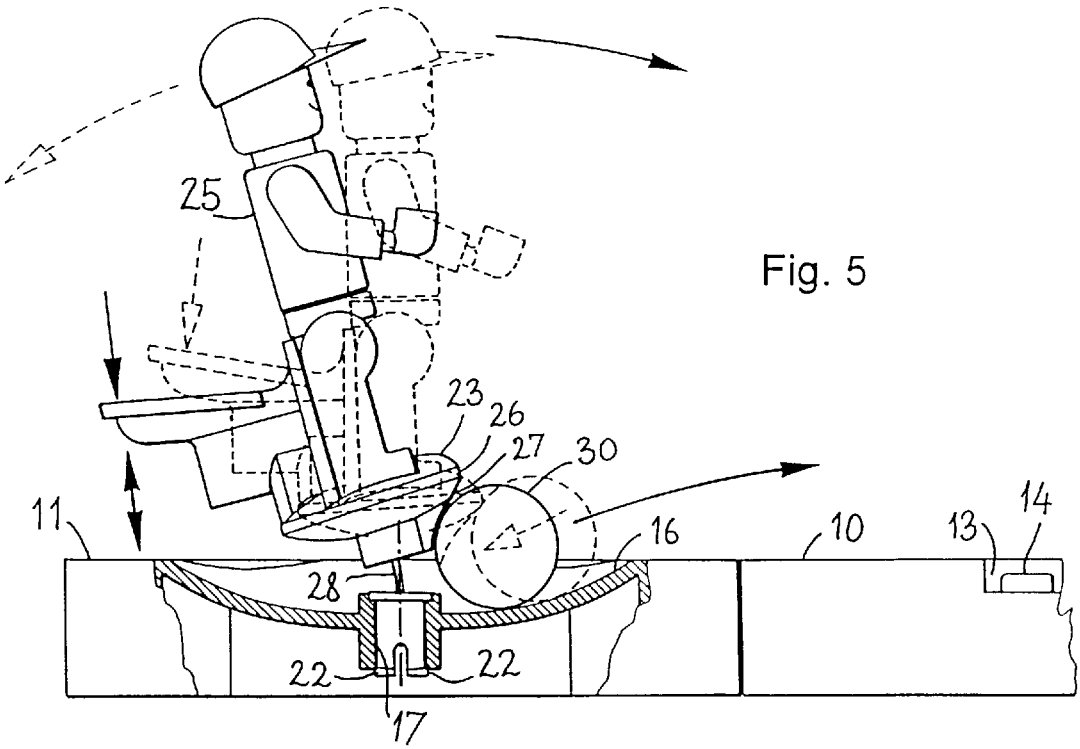
FIG. 5 is a partially sectional view through a field wherein a play mechanism is mounted.

FIG. 5 shows the play mechanism 20 arranged on a square field element 11 wherein the stud 21 has been introduced into the sleeve 17 in such a manner that the snap beads 22 are situated below the lowermost end of the tubular sleeve 17 in order to hereby secure the play mechanism with a snap mechanism in the sleeve to enable ready replacement. The play mechanism is able to rotate within the sleeve. A prior art toy FIG. 25 is arranged on the play mechanism 20 with the coupling studs 24 received in corresponding coupling cavities at the bottom of the toy figure legs. The toy figure will simulate a football player, and it can readily be removed from the play mechanism and be replaced by another toy figure.

FIG. 5 illustrates how an influence exerted on the arm 29 with a downwardly oriented force, eg by pressing the arm with a finger, can flex the play mechanism 25 away from of its neutral position as shown with a dotted line and into a flexed position as it is shown with a fully drawn line.

FIG. 5 also shows a ball or other spherical object 30 which is situated in the cavity 16 where it will, due to gravity, seek towards the lowest point as determined by the cavities 26 and 27 in the base element 23, since the base element will in all other places protrude further in the horizontal direction whereby the ball will, in all other positions in which it is in contact with the base element, be situated higher up in the cavity 16 than is the case when it is in contact with the cavities 26 or 27. In the neutral position of the player figure, the ball will be in contact with the cavity 26 at the periphery of the base element, and in the flexed position of the play mechanism, the ball will be in contact with the cavity 27 which is a continuation of the cavity 26.

Figure 4:
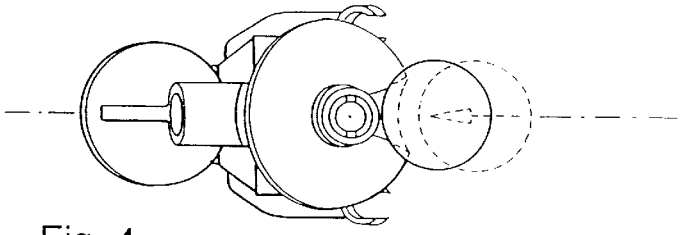
FIG. 4 is a bottom view of the play mechanism shown in FIGS. 2 and 3.
Figure 6:
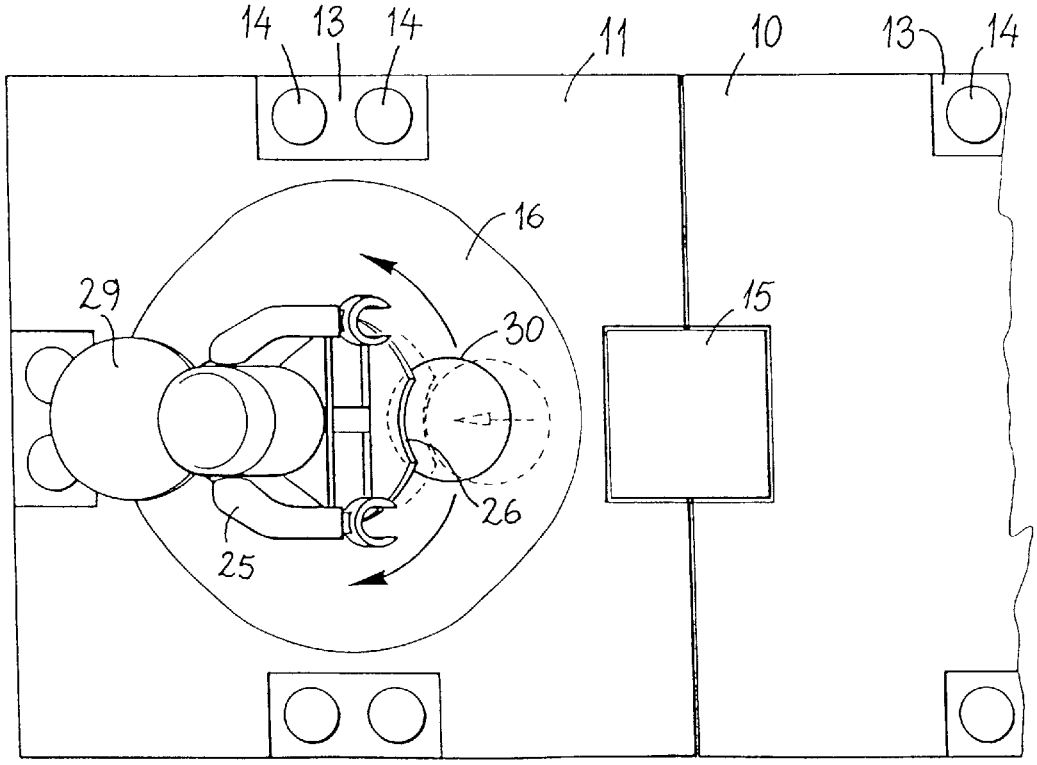
FIG. 6 is a top view of the field with the play mechanism shown in FIG. 5.

In FIGS. 4, 5 and 6 the ball 30 is shown in the cavity 16 where the ball rests against the base element 23. Owing to gravity, the ball will seek towards the lowermost point in the cavity 16, and due to the configuration of the base element with the cavity 26 in the otherwise circular periphery, the ball will, in the neutral position, be steadily positioned in the cavity 26 of the base element, which cavity is in front of the player FIG. 25. When the play mechanism 20 with the player FIG. 25 is turned such that the player figure faces with its front in another direction, the ball will still remain in the cavity 26 in the base element. This also applies to the ball in the flexed position of the play mechanism, in which it will remain in the cavity 27 on the lower face of the base element. The cavities 26 and 27 in the base element thus co-operate with the cavity 26 in the playface to ensure that the ball will always be steadily positioned in front of the player FIG. 25 on the play mechanism, and when the play mechanism is turned the ball will follow and remain stable in front of the player figure. This allows the user to aim very accurately prior to kicking the ball.

In use, the game will function as explained in the following, assuming that the game is a football game with two teams. When a player has kicked the ball, gravity will cause it to seek down into a cavity 16 at another (or the same) player where it can abut anywhere on the base element of the play mechanism. Thus, by means of the arm 29 the user can turn the play mechanism until the cavity is in contact with the ball, following which the ball will rest in one of these cavities that are exactly in front of the player figure. Now the user can aim in a specific direction by turning the play mechanism whereby the ball will, in accordance with the above, follow and remain in front of the player figure. Then the user will use his finger to press the arm 29 downwards whereby the ball will be in contact with the cavity 27 on the bottom face of the base element 23, and also in this flexed position the play mechanism can be turned and the direction of aim can be changed. The user allows the figure to 'kick' the ball by letting go of the arm 29 whereby the play mechanism will revert to its neutral position by means of the spring, and by this movement the all will be 'kicked' away from the play mechanism.

The user can choose to flex the play mechanism much or slightly away from the neutral position prior to kicking. Thus the user can choose to kick with low strength or with high strength. A low-strength kick will cause the ball to merely roll across the playface and a high-strength kick will enable the ball to rise above the playface due to the cavity 16 in the playface.

The toy FIG. 25 that simulates a player can be removed and replaced by another figure. This enables the user to position his players on the field as desired. The play mechanism with or without player figure can also be removed and positioned as desired. This means that the players are not restricted to specific positions on the field, and the user is allowed to select specific positions for his players prior to the game, and during the game it will be possible to move the players to other positions on the field, if desired.

What is claimed is:

1. A toy ball game with a playface and a ball, wherein the playface has a horizontally extending top face and a play mechanism arranged above the playface, the play mechanism having a vertical axis and a contact face with a concave portion having a limited angular extension about the vertical axis so that the concave portion matches the ball, whereby the ball can assume a stable position in contact with the concave portion of the contact face, the play mechanism having a neutral position and arranged for being selectively flexed away from the neutral position and by spring force revert to the neutral position and thereby cause the ball to move away from the play mechanism and across the top face of the playface.

2. A toy ball game according to claim 1, wherein the top face of the playface has a cavity with a lowermost portion, and wherein the play mechanism is arranged at the lowermost portion of the cavity.

3. A toy ball game according to claim 1, wherein the play mechanism is selectively rotatable about a vertical axis.

4. A toy ball game according to claim 1, wherein the play mechanism has an arm protruding transversally to the play mechanism, the arm being configured for responding to a force acting vertically on the arm to flex the play mechanism from its neutral position.

5. A toy ball game with a playface and a ball, wherein the playface has a horizontally extending top face and a play mechanism arranged above the playface, the play mechanism having a contact face with a concave portion that matches the ball whereby the ball can assume a stable position in contact with the concave portion of the contact face, the play mechanism having a neutral position and arranged for being selectively flexed away from the neutral position and by spring force revert to the neutral position and thereby cause the ball to move away from the play mechanism and across the top face of the playface, wherein the play mechanism has coupling means for releasably securing a toy figure that simulates a player and has corresponding coupling means.

6. A toy ball game with a playface and a ball, wherein the playface has a horizontally extending top face and a play mechanism arranged above the playface, the play mechanism having an arm protruding transversally to the play mechanism, the arm being configured for responding to a force acting vertically on the arm to flex the play mechanism from its neutral position, the play mechanism having a neutral position and arranged for being selectively flexed away from the neutral position and by spring force revert to the neutral position and thereby cause the ball to move away from the play mechanism and across the top face of the playface.

7. A toy ball game according to claim 6, wherein the top face of the playface has a cavity with a lowermost portion, and wherein the play mechanism is arranged at the lowermost potion of the cavity.

8. A toy ball game according to claim 6, wherein the play mechanism is selectively rotatable about a vertical axis.

9. A toy ball game according to claim 6, wherein the play mechanism has a contact face with a concave portion that matches the ball, whereby the ball can assume a stable position in contact with the concave portion of the contact face.

10. A toy ball game according to claim 6, wherein the play mechanism has coupling means for releasably securing a toy figure that simulates a player and has corresponding coupling means.

* * * * *